US007965847B2

(12) United States Patent
Nakamura

(10) Patent No.: US 7,965,847 B2
(45) **Date of Patent: *Jun. 21, 2011**

(54) SPEAKER SYSTEM

(75) Inventor: Takeshi Nakamura, Uji (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 406 days.

This patent is subject to a terminal disclaimer.

(21) Appl. No.: 12/237,663

(22) Filed: Sep. 25, 2008

(65) Prior Publication Data

US 2009/0028378 A1 Jan. 29, 2009

Related U.S. Application Data

(63) Continuation of application No. 10/733,040, filed on Dec. 11, 2003, now Pat. No. 7,447,316.

(30) Foreign Application Priority Data

Feb. 10, 2003 (JP) ..... 2003-032061
Jun. 10, 2003 (JP) ..... 2003-164936

(51) Int. Cl.
*H04R 5/00* (2006.01)
*H04R 5/02* (2006.01)

(52) U.S. Cl. ..... 381/17; 381/300; 381/303

(58) Field of Classification Search ..... 381/17, 381/18, 71.7, 71.8, 300, 303, 304, 305, 336
See application file for complete search history.

(56) References Cited

U.S. PATENT DOCUMENTS 4,322,678 A 3/1982 Capots et al.
4,440,259 A 4/1984 Strohbeen
6,215,883 B1 4/2001 Leonarz

FOREIGN PATENT DOCUMENTS

JP 05-103391 * 4/1993

OTHER PUBLICATIONS

Official communication issued in counterpart European Application No. 04 000 774.2, mailed on Feb. 3, 2009.
Nakamura; "Speaker System"; U.S. Appl. No. 10/733,040, filed Dec. 11, 2003.

* cited by examiner

*Primary Examiner* — Brian Ensey
(74) *Attorney, Agent, or Firm* — Keating & Bennett, LLP

(57) ABSTRACT

A speaker system includes a main speaker and a subordinate speaker arranged around the main speaker. A pseudo-spherical wave is generated around the main speaker as a whole such that both speakers are vibrated in the frequency range of piston vibration and are in phase and that the propagation speed of a sound wave produced by the vibration of the subordinate speaker is preferably lower than the propagation speed of a sound wave produced by the vibration of the main speaker.

4 Claims, 7 Drawing Sheets

SPEAKER SYSTEM

BACKGROUND OF THE INVENTION

1. Field of the Invention

The present invention relates to a speaker system in which a pseudo-spherical sound wave is generated by a combination of a plurality of speakers.

2. Description of the Related Art

Generally, speakers used in the pure audio field are required to ensure sufficient sound volume and have a mellow and rich tone quality.

Now, among related art speakers, a cone-type speaker using a cone-shaped diaphragm plate, a dome-type speaker in which the convex side of a dome-shaped diaphragm defines a sounding portion, and other speakers, have been disclosed (see Denkidenshikogaku-Daihyakkajiten, Vol. 25 "AUDIO & VIDEO" compiled by Shigenobu Tsuji, issued in November, 1983, from Denkishoin; and Japanese Unexamined Patent Application Publication No. 11-196485, for example).

Furthermore, in the related art speakers, what is called a tonzoile speaker in which a plurality of speakers having the same kind and same size openings are arranged linearly or along a curved line, a composite speaker in which speakers having different-size openings are arranged in a speaker box so as to be close to each other, and others have been disclosed (see Hosogijutsusosho "Onkyo-kiki" compiled by NHK (Japan Broadcasting Corporation), issued on Jul. 1, 1963, from Gihodou; Japanese Unexamined Patent Application Publication No. 2-239798; and Japanese Unexamined Patent Application Publication No. 5-103391, for example).

Since a sound wave is generated by the back-and-forth piston movement of the cone-shaped diaphragm plate in the related cone-type speaker, a large sound volume is easily obtained. However, since the diaphragm plate only performs back-and-forth piston movements, the radiated wave front of the sound wave forms a substantially flat wave. Since the sound wave is not a spherical wave as in the above-mentioned dome-type speaker, disturbance (turbulent flow) of the air is produced between a vibrating area and a non-vibrating area and it is difficult to obtain a mellow and rich tone quality. Moreover, the vibrating area defines a substantially cylindrical area where the air is directly vibrated by the vibration of the diaphragm plate, the surface of which defines a bottom surface of the cylindrical area.

On the other hand, since the latter dome-type speaker produces a sound wave by the expansion and contraction movement of the diaphragm plate, the sound wave is naturally a spherical wave. Such a spherical wave advantageously generates a mellow and rich tone quality. However, although the whole diaphragm plate moves in the cone-type speaker, the whole diaphragm does not move in the dome-type speaker. The outer edge portion of the semi-spherical diaphragm plate is secured, and a sound wave is generated by the expansion and contraction of the diaphragm plate. Therefore, a large amplitude is not expected, and accordingly, it is difficult to obtain a large volume.

Furthermore, the above-mentioned tonzoile speaker is used to reduce howling effects in a hall and theater such that a sharp directivity is provided in a particular direction by changing the sound volume and phase of each speaker, and, since disturbances of the air are not taken into consideration, tone quality cannot be improved. In particular, when a plurality of speakers are arranged along a curved line, the mounting angle and driving method of each speaker is complicated and difficult to set, and the construction of a speaker box is complicated and more expensive.

Moreover, Japanese Unexamined Patent Application Publication No. 2-239798 discloses that the sound pressure of a speaker in the middle is greater than that of speakers at both ends. In generally, the sound pressure means the pressure of a sound at a point which is a fixed distance away from a speaker. However, in the case of a speaker having a large diameter, even a small amplitude produces a large sound pressure, and in the case of a speaker having a small diameter, even a large amplitude produces only a small sound pressure. As it is understood from the above, the sound pressure does not necessarily mean the amplitude of the speaker. Accordingly, even if a difference in sound pressure is provided, disturbances of the air cannot be prevented.

Furthermore, in the composite speaker, a uniform frequency characteristic as a whole is obtained by providing speakers having large and small diameters that share the frequency range. Therefore, in the same manner as described above, the composite speaker is not intended to improve deterioration of the tone quality caused by disturbance of the air.

SUMMARY OF THE INVENTION

To overcome the problems described above, preferred embodiments of the present invention provide a speaker system in which sufficiently large sound volume is ensured, disturbances of the air are prevented, and a mellow and rich tone quality is obtained.

In a first preferred embodiment of the present invention, a speaker system includes a main speaker and a subordinate speaker. In the speaker system, a pseudo-spherical wave with the main speaker at the center thereof is generated as a whole such that both speakers are vibrated in the frequency range of piston vibration and are in phase with each other and that the propagation speed of a sound wave produced by the vibration of the subordinate speaker is preferably lower than the propagation speed of a sound wave produced by the vibration of the main speaker. Thus, since the entire speaker system radiates a sound wave as a pseudo-spherical wave, there is very little disturbance of the air, natural sounds are transmitted, and a mellow and rich tone quality is obtained.

In preferred embodiments of the present invention, the main speaker and the subordinate speaker are preferably constructed such that both speakers are arranged substantially on the same surface so as to face in the same direction and not to lie one on top of another and so that the subordinate speaker is vibrated with a smaller amplitude than the main speaker. Thus, preferred embodiments of the present invention can be applied where the directivity of propagation of a sound wave in a particular direction is required.

In preferred embodiments of the present invention, the subordinate speaker is larger in diameter than the main speaker and both speakers have the same axis.

Furthermore, a plurality of the subordinate speakers are provided and the farther the subordinate speaker is located from the main speaker, the smaller amplitude with which the subordinate speaker is vibrated. Thus, the sound sources are not scattered and listening positions are widened.

In preferred embodiments of the present invention, a plurality of the subordinate speakers are provided and, while the main speaker is disposed in the center, the subordinate speakers are arranged around the main speaker so as to have the same center.

Furthermore, a plurality of subordinate speakers which are spaced different distances from the main speaker are provided and the farther away from the main speaker the subordinate speaker is located, the smaller amplitude with which the subordinate speaker is vibrated. Thus, even if each of the speakers is small in diameter, the speaker system enables both the same sound volume as a large-diameter speaker and a delicate sound to be realized with only small-diameter speakers. In addition, modulation caused by the mutual interference of sounds, which is caused, for example, when the sound radiated from the main speaker directly reaches the outer subordinate speakers, is effectively prevented, and accordingly, very little disturbance of sounds is caused and natural sounds are transmitted.

In preferred embodiments of the present invention, the main speaker and the subordinate speakers have substantially the same acoustic characteristics and the main speaker is arranged between the two subordinate speakers. The speakers are arranged so as to be substantially linear in a direction which is substantially perpendicular to the sound wave propagation direction, and a first signal line, in which the subordinate speakers are connected in series, and a second signal line, in which the main speaker is connected, are connected in parallel. Thus, since the construction of a speaker box is simple and the connection is simple, the cost is greatly reduced.

In preferred embodiments of the present invention, the main speaker and the subordinate speakers are arranged such that the speakers lie one on top of another with a fixed space therebetween and the main speaker is disposed in the middle and each speaker is provided with a sound wave propagation opening portion such that a sound wave radiated from each speaker is radiated in a direction which is substantially perpendicular to the propagation direction thereof.

In preferred embodiments of the present invention, the main speaker and the subordinate speakers have substantially the same acoustic characteristics and the speakers are arranged such that the main speaker is disposed between the subordinate speakers, the sound wave propagation opening portion corresponding to the main speaker and the sound wave propagation opening portion corresponding to the subordinate speaker have substantially the same opening area, and a first signal line, in which the subordinate speakers are connected in series, and a signal line, in which the main speaker is connected, are connected in parallel.

In preferred embodiments of the present invention, the main speaker and the subordinate speakers have substantially the same acoustic characteristics and the speakers are arranged such that the main speaker is disposed between the subordinate speakers, the opening area of the sound wave propagation opening portion corresponding to the main speaker is preferably smaller than the opening area of the sound wave propagation opening portion corresponding to the subordinate speaker, and the main speaker and the subordinate speakers are connected in parallel to an audio signal line.

According to preferred embodiments of the present invention, a wave front radiated from the speaker system is closer to a spherical wave. Furthermore, since a pseudo-spherical wave is omnidirectionally radiated, a nondirectional speaker is obtained. Therefore, a much mellower and natural tone quality is obtained.

Other features, elements, characteristics and advantages of the present invention will become more apparent from the following detailed description of preferred embodiments thereof with reference to the attached drawings.

DETAILED DESCRIPTION OF PREFERRED EMBODIMENTS

First Preferred Embodiment

Figure 1:
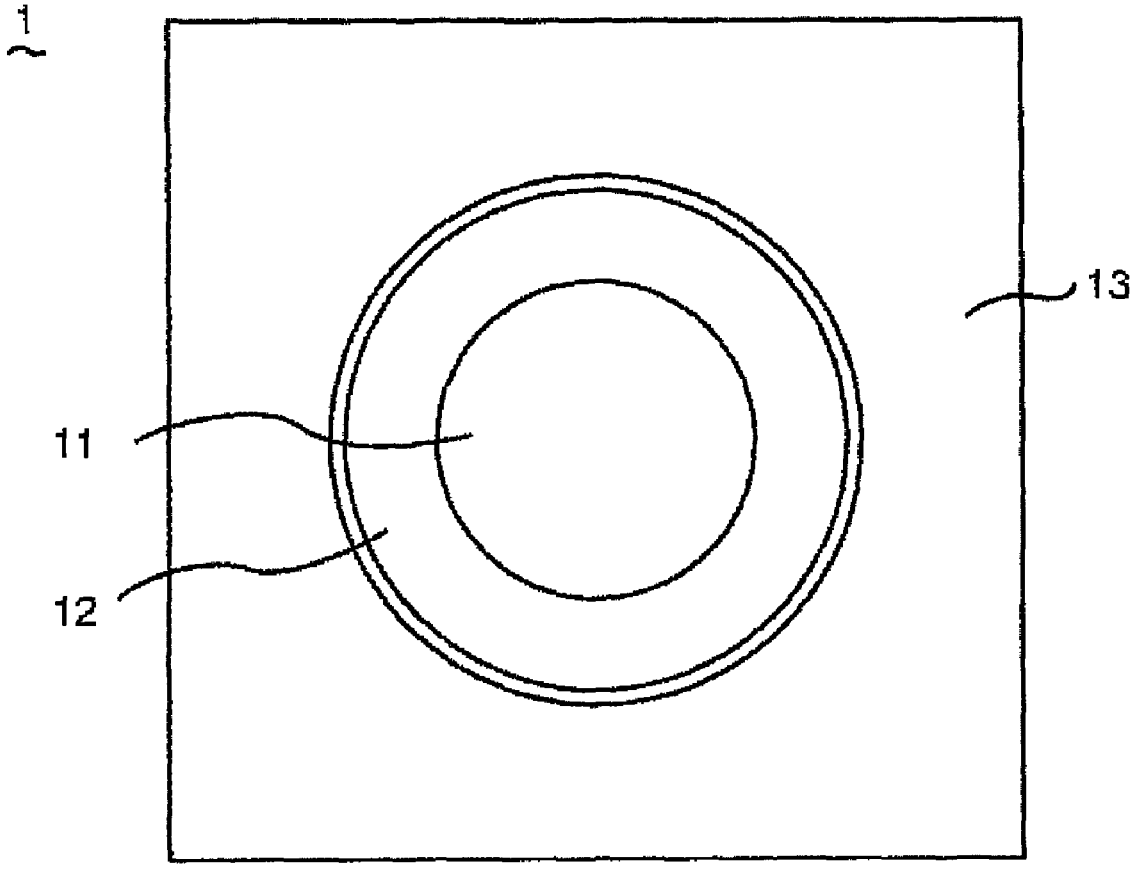
FIG. 1 is a front view showing the arrangement of speakers in a speaker system according to a first preferred embodiment of the present invention.
Figure 2:
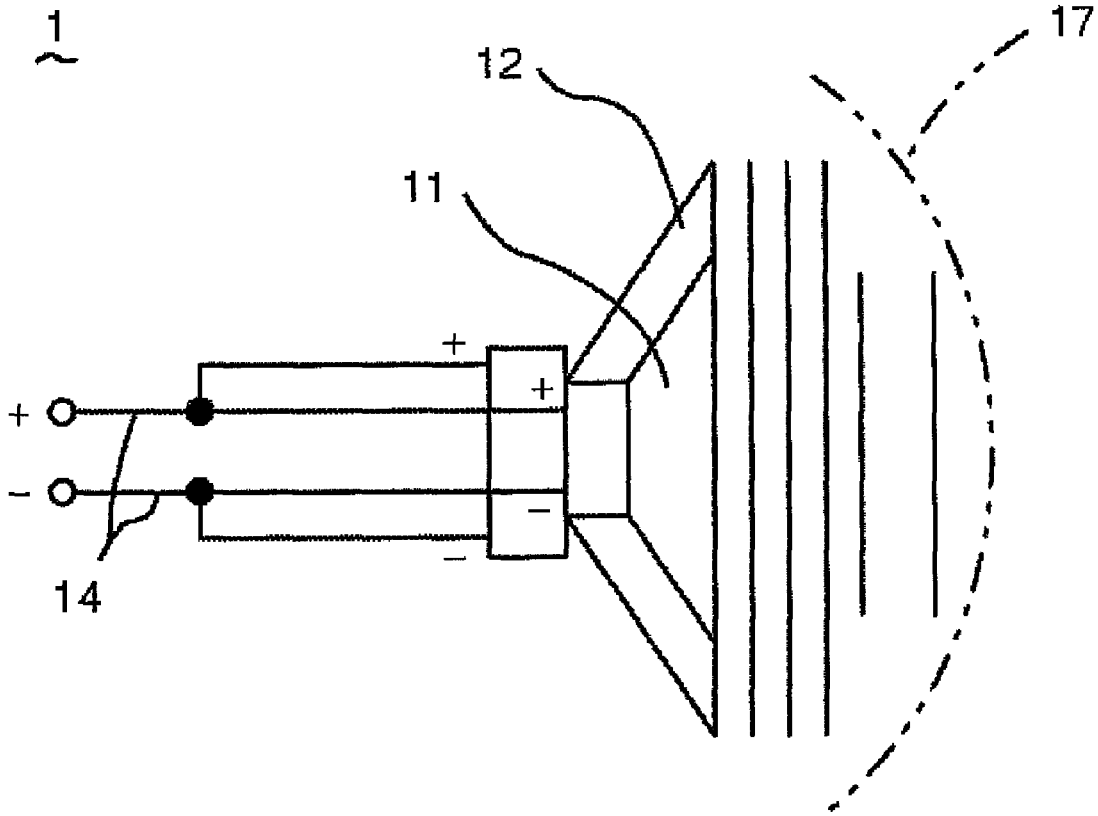
FIG. 2 shows the whole construction of the speaker system according to the first preferred embodiment of the present invention.

FIG. 1 is a front view showing the arrangement of speakers in a speaker system according to a first preferred embodiment of the present invention, and FIG. 2 shows the entire construction of the speaker system.

A speaker system 1 according to the first preferred embodiment preferably includes a main speaker 11 and a subordinate speaker 12. In each of the speakers 11 and 12, for example, a cone-type dynamic speaker is preferably used. Both speakers 11 and 12 are arranged so as to face in the same direction, have the same axis, and not lie one on top of another on the same surface on the front side of a speaker box 13.

Furthermore, the subordinate speaker 12 is set to have substantially twice as large an opening area as the main speaker, and the main speaker 11 and the subordinate speaker 12 are connected in parallel to an audio signal line 14.

In the speaker system 1, an audio signal input through the audio signal line 14 is applied to the main speaker 11 and the subordinate speaker 12. Then, when the frequency of the audio signal is within the frequency range of piston vibration of the speakers 11 and 12, the subordinate speaker 12 is vibrated so as to have the same phase and about one-half the amplitude as the main speaker 11 in the non-vibration area away from the vibration area which is vibrated by the main speaker 11. In this manner, when the vibration speed of air particles produced by the vibration of a speaker is defined as the propagation speed of a sound wave, the propagation speed of a sound wave produced by the vibration of the subordinate speaker 12 is substantially one-half of the vibration speed of a sound wave produced by the vibration of the main speaker 11. As a result, as shown by a two-dot chain line, the wave front of the propagation is a pseudo-spherical wave 17, when the speaker system 1 is viewed as a whole.

In the first preferred embodiment, since each of the main speaker 11 and the subordinate speaker 12 includes a cone-type dynamic speaker, sufficiently large sound volume is obtained when compared with when a dome-type speaker of the same size is used. Furthermore, since the main speaker 11 and the subordinate speaker 12 are arranged on the same surface so as not to lie one on top of another and the subordinate speaker 12 is vibrated so as to have the same phase and about one-half amplitude as the main speaker 11 in the non-vibration area which is not vibrated by the main speaker, the speaker system 1 generates a propagation wave front that is substantially a spherical wave as a whole. Therefore, a mellow and rich tone quality is obtained. Furthermore, very little disturbance of the air is caused, natural sounds are transmitted, and sound sources are not scattered. Accordingly, the acoustic orientation is stabilized and wide listening positions are obtained.

Second Preferred Embodiment

Figure 3:
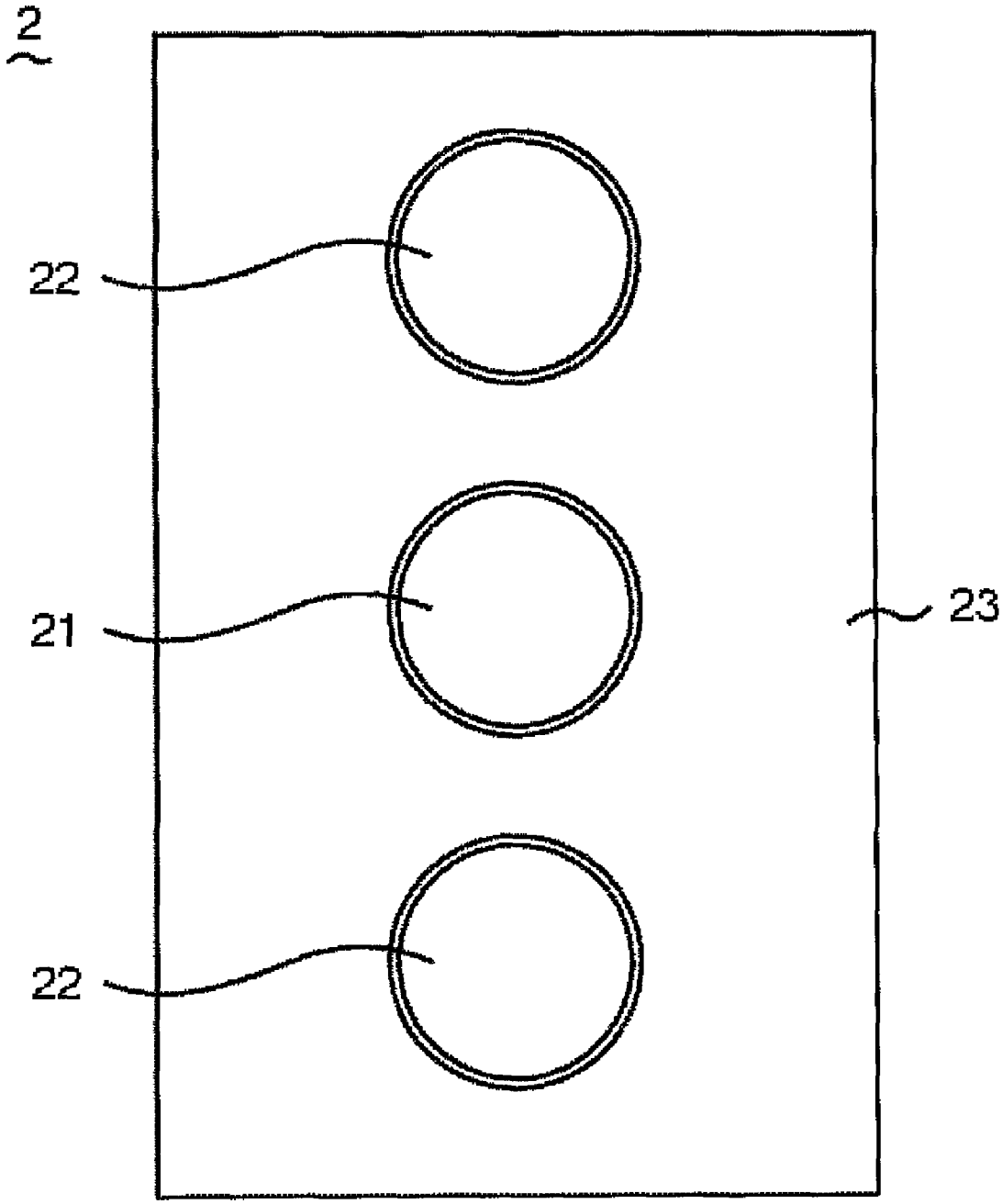
FIG. 3 is a front view showing the arrangement of speakers in a speaker system according to a second preferred embodiment of the present invention.
Figure 4:
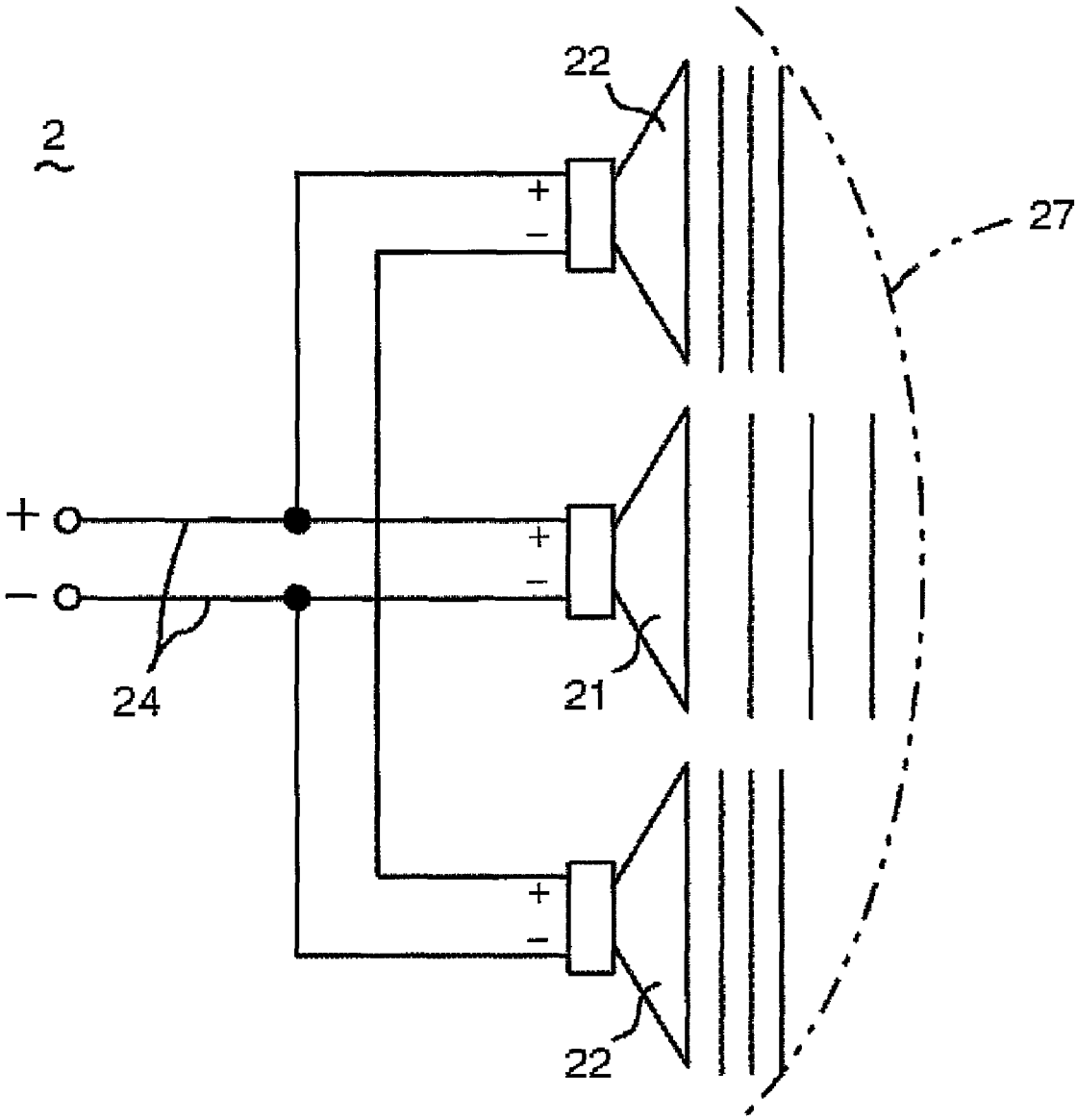
FIG. 4 shows the whole construction of the speaker system according to a second preferred embodiment of the present invention.

FIG. 3 is a front view showing the arrangement of speakers in a speaker system according to a second preferred embodiment of the present invention, and FIG. 4 shows the entire construction of the speaker system.

A speaker system 2 according to the second preferred embodiment includes a main speaker 21 and a pair of upper and lower subordinate speakers 22 arranged so as to sandwich the main speaker 21. In each of the speakers 21 and 22, for example, a cone-type dynamic speaker is used. Each of the cone-type dynamic speakers has the same acoustic and electrical characteristics and substantially the same opening area.

Furthermore, the speakers are arranged substantially linearly in a longitudinal direction which is substantially perpendicular to the sound wave propagation direction on the front-side same surface of a speaker box 23 such that non-vibration areas away from a vibration area which is vibrated by the main speaker 21 are vibrated by the subordinate speakers 22. Moreover, the arrangement of the speakers 21 and 22 is not limited to the longitudinal direction and may be arranged laterally. Then, the subordinate speakers 22 are electrically connected in series to each other and they are connected in parallel to an audio signal line 24 directly connected to the main speaker 21.

In the speaker system 2 having the above-described construction, an audio signal input through the audio signal input line 24 is input to the central main speaker 21 with a signal level. However, since the upper and lower speakers 22 are connected in series, an audio signal having substantially one-half of the signal level is input to each of the subordinate speakers 22.

Accordingly, when the frequency of the input audio signal is in the frequency range of piston vibration of the speakers 21 and 22, the subordinate speakers 22 vibrate the non-vibration areas of the main speaker 21 so as to be in phase with the main speaker 21 and have about one-half amplitude as the main speaker 21. In this manner, the propagation speed of sound waves generated by the subordinate speakers 22 is substantially one-half of the propagation speed of a sound wave generated by the main speakers 21. As a result, as shown by a two-dot chain line in FIG. 4, the speaker system 2 as a whole produces a propagation wave front as a pseudo-spherical wave 27.

In this manner, in the second preferred embodiment, since each of the main speaker 21 and subordinate speakers 22 includes a core-type dynamic speaker having substantially the same acoustic characteristics, even if the main speaker 21 and subordinate speakers 22 have small openings, the combination of the speakers 21 and 22 has the same sound volume as a large-diameter speaker, and, although the speakers have a large total area, the speakers also produce delicate sound which can be obtained by small-diameter speakers.

Furthermore, the main speaker 21 and the subordinate speakers 22 are substantially linearly arranged on the same surface in a direction which is substantially perpendicular to the sound wave propagation direction, and the subordinate speakers 22 vibrate non-vibration areas of the main speaker 21 so as to be in phase with the main speaker 21 and have about one-half amplitude as the main speaker 21. Accordingly, the speaker system produces a propagation wave front that is substantially a spherical wave as a whole. As a result, there is no disturbance of the air and a mellow and rich tone quality is obtained.

Furthermore, since the main speaker 21 and the subordinate speaker 22 are arranged in a longitudinal line on the same surface of the speaker box 23, the construction of the speaker box 23 is simple, and, since the connection is also simple, the cost of the speaker system is greatly reduced.

Figure 5:
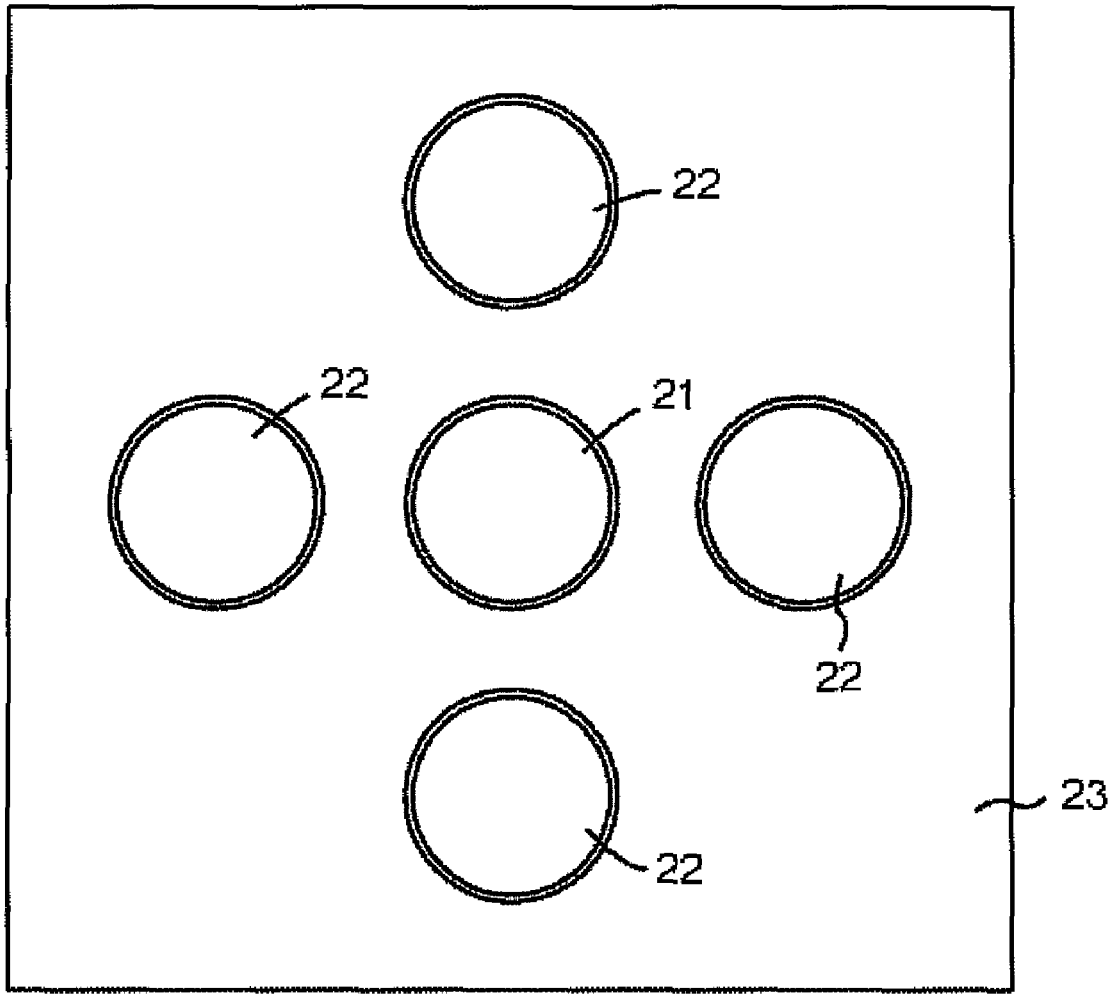
FIG. 5 is a front view showing a modified example of the arrangement of speakers in the speaker system according to a second preferred embodiment of the present invention.

Moreover, in the second preferred embodiment, although the main speaker 21 and the subordinate speaker 22 are linearly arranged, the arrangement is not limited to that arrangement, and, for example, as shown in FIG. 5, a speaker system can be constructed to generate a pseudo-spherical wave such that the left and right and upper and lower subordinate speakers 22 are arranged around the main speaker 21. Furthermore, the subordinate speakers 22 may be circularly arranged around the main speaker 21.

Third Preferred Embodiment

Figure 6:
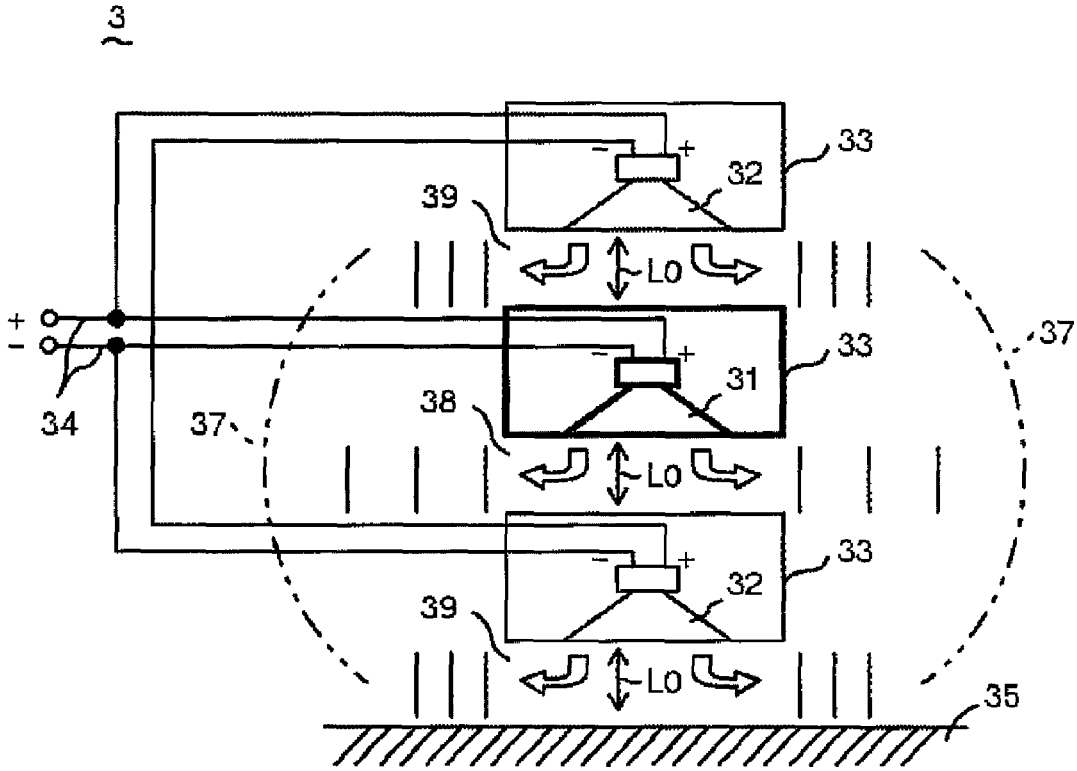
FIG. 6 shows the whole construction of a speaker system according to a third preferred embodiment of the present invention.

FIG. 6 shows the entire construction of a speaker system according to a third preferred embodiment of the present invention.

A speaker system 3 according to the third preferred embodiment includes a main speaker 31 and a pair of subordinate speakers 32 which are arranged so as to sandwich the main speaker 31 from the upper and lower sides. In each of the speakers 31 and 32, for example, a cone-type dynamic speaker is used, and the speakers 31 and 32 have the same acoustic and electrical characteristics and have substantially the same opening area.

Furthermore, the speakers 31 and 32 are mounted on the front side of speaker boxes 33 so as to face downward. Each speaker box 33 is integrally supported by supports (not illustrated) such that the speakers 31 and 32 lie one on top of another on the same axis with a fixed space therebetween.

Accordingly, the speaker box 33 of the main speaker 31 defines a reflecting plate for the upper subordinate speaker 32, the speaker box 33 of the lower subordinate speaker 32 defines a reflecting plate for the main speaker 31, and a floor surface 35, on which supports (not illustrated) are disposed, defines a reflecting plate for the lower subordinate speaker 32. Moreover, a reflecting plate may be used instead of the floor surface 35.

In this manner, the spaces between the speaker boxes 33 and the space between the speaker box 33 and the floor surface 35 define sound wave propagation opening portions 38 and 39. The sound wave propagation opening portions 38 and 39 are arranged such that a sound wave radiated from each of the speakers 31 and 32 is omnidirectionally emitted. Moreover, in the third preferred embodiment, the spaces L0 between the speakers 31 and 32 and the upper surface of the speaker boxes 33 directly under the speakers 31 and 32 or the floor surface 35 are preferably substantially the same. Therefore, each of the sound wave propagation opening portions 38 and 39 corresponding to the speakers 31 and 32 has substantially the same area.

Furthermore, while the subordinate speakers 32 are electrically connected in series and the main speaker 31 is directly connected to an audio signal line 34, the main speaker 31 and the subordinate speakers 32 are connected in parallel to the audio signal line 34.

In the speaker system 3 having the above-described construction, an audio signal input through the audio signal line 34 is input to the main speaker 31 in the middle with a desired signal level. However, since the upper and lower subordinate speakers 32 are connected in series, an audio signal of substantially one-half of the desired signal level is input to each subordinate speaker 32.

Therefore, when the frequency of the input audio signal is within the frequency range of piston vibration of each of the speakers 31 and 32, the subordinate speakers 32 vibrate non-vibration areas of the main speaker 31 such that the subordinate speakers 32 are in phase with the main speaker 31 and have about one-half amplitude of the main speaker 31.

Then, the sound waves radiated from the speakers 31 and 32 are reflected on the upper surface of the speaker boxes 33 or the floor surface 35, and, after passing through the sound wave propagation opening portions 38 and 39 which correspond to the speakers 31 and 32, the sound waves are omni-directionally radiated in a direction which is substantially perpendicular to the direction in which the speakers 31 and 32 lie one on top of another. Since the spaces L0 between the speakers 31 and 32 and the upper surface of the speaker boxes 33 directly under the speakers 31 and 32 or the floor surface 35 are substantially the same, the opening area of the sound wave propagation opening portions 38 and 39 corresponding to the speakers 31 and 32 is substantially the same.

Accordingly, the propagation speed of a sound wave at the sound wave propagation opening portion 39 generated when the subordinate speaker 32 is vibrated is substantially one-half of the propagation speed of a sound wave at the sound wave propagation opening portion 38 generated when the main speaker 31 is vibrated. As a result, as shown by a two-dot chain line in FIG. 6, in the speaker system 3 as a whole, the propagation wave front defines a pseudo-spherical wave 37. Moreover, the pseudo-spherical wave 37 is nondirectional because it is omnidirectionally radiated.

Thus, the speaker system 3 of the third preferred embodiment produces a propagation wave front that is substantially a spherical wave as a whole, and the speaker system 3 is nondirectional. Accordingly, there is no disturbance of the air and a mellow and rich natural tone quality are obtained.

Fourth Preferred Embodiment

Figure 7:
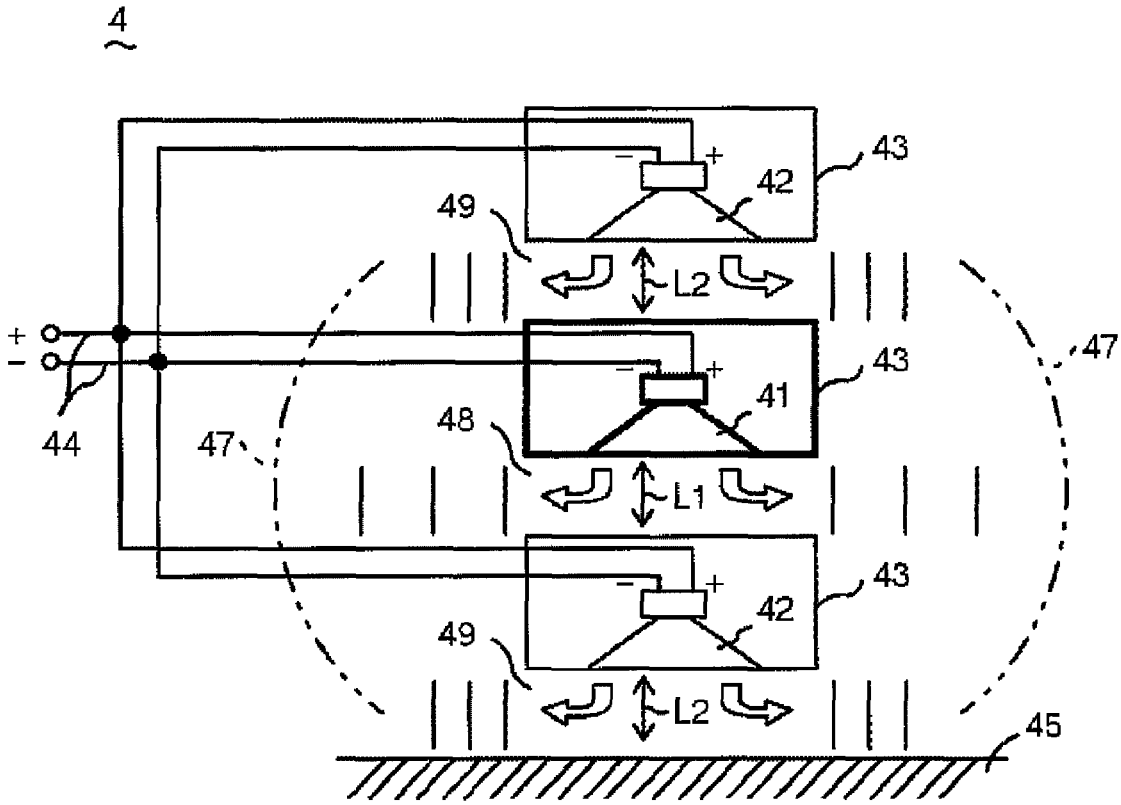
FIG. 7 shows the whole construction of a speaker system according to a fourth preferred embodiment of the present invention.

FIG. 7 shows the entire construction of a speaker system according to a fourth preferred embodiment of the present invention.

In a speaker system 4 of the fourth preferred embodiment, the space L1 between the main speaker 41 and the upper surface of a speaker box 43 below the main speaker 41 is preferably narrower than the space L2 between the subordinate speaker 42 and the upper surface of a speaker box 43 below the subordinate speaker 42 or the floor surface 45. In addition, the main speaker 41 and the subordinate speakers 42 are connected in parallel to an audio signal line 44. Moreover, reference numeral 45 represents a floor surface.

Since the remaining construction is the same as the third preferred embodiment, the detailed description is omitted.

In the speaker system 4 having the above-described construction, both the main speaker 41 and subordinate speaker 42 are connected in parallel to the audio signal line 44. Therefore, an audio signal input through the audio signal line 44 has the same signal level to each of the speakers 41 and 42. Accordingly, when the input audio signal is in the frequency range of piston vibration of each of the speakers 41 and 42, the subordinate speakers 42 are vibrated such that the subordinate speakers 42 are in phase with the main speaker 41 and have the same amplitude as that of the main speaker 41.

Then, the sound waves radiated from the speakers 41 and 42 are reflected on the speaker boxes 43 or the floor surface 45, and, after passing through the sound wave propagation opening portions 48 and 49 corresponding to the speakers 41 and 42, the sound waves are omni-directionally radiated in a direction which is substantially perpendicular to the direction in which the speakers 41 and 42 lie one on top of another.

In the fourth preferred embodiment, the spaces L1 and L2 are set such that the opening area of the sound wave propagation opening portion 48 corresponding to the main speaker 41 is substantially one-half of the opening area of the sound wave propagation opening portion 49 corresponding to the subordinate speakers 42. Accordingly, even if the speakers 41 and 42 are vibrated such that the main speaker 41 and the subordinate speakers 42 are in phase and have the same amplitude, the propagation speed of a sound wave at the sound wave propagation opening portion 49 generated when the subordinate speaker 32 is vibrated is substantially one-half of the propagation speed of a sound wave at the sound wave propagation opening portion 48 generated when the main speaker 42 is vibrated. As a result, as shown by a two-dot chain line in FIG. 7, the propagation wave front defines a pseudo-spherical wave 47 when the speaker system is considered as a whole. Moreover, since the pseudo-spherical wave 47 is omni-directionally radiated, the wave 47 is nondirectional.

Thus, the speaker system 4 of the fourth preferred embodiment produces a propagation wave front that is substantially a spherical wave when the speaker system 4 is viewed as a whole, and the propagation wave front is nondirectional. Therefore, there is no disturbance of the air and a mellow and rich natural tone quality is obtained.

Regarding the above-described preferred embodiments 1 to 4, the following modifications and applications can be considered.

In the above-described first and second preferred embodiments, one subordinate speaker 12 is arranged around a main speaker so as to have the same axis and a plurality of subordinate speakers 22 are arranged at substantially equal distances from a main speaker 21. However, three or more subordinate speakers may be coaxially provided around a main speaker, and also multistage subordinate speakers may be concentrically provided around a main speaker. In these cases, the farther the subordinate speaker is separated from the main speaker, the smaller amplitude with which the subordinate speaker is vibrated.

Moreover, in the first and second preferred embodiments, the main speakers 11 and 21 and subordinate speakers 12 and 22 are all arranged on the same surface. Since a propagation wave front from the speaker system is much closer to a spherical wave when constructed in this manner, such a construction is desirable, however, it is possible to arrange the subordinate speakers 12 and 22 so as to be slightly moved away from the main speakers 11 and 21.

In the above-described second and third preferred embodiments, although the amplitude of an audio signal is preferably set to one-half by connecting the subordinate speakers 22 and 32 in series, it is possible to make the amplitude of an audio signal provided to each of the subordinate speakers 22 and 32 one-half by connecting an attenuator to each of the subordinate speakers 22 and 32. Furthermore, the input impedance of the subordinate speakers 22 and 32 may be made larger than the input impedance of the main speakers 21 and 31, or subordinate speakers 22 and 32 having lower efficiencies than the main speakers 21 and 31 may be used. In this manner, even if an audio signal of substantially the same amplitude is applied to the main speakers 21 and 31 and the subordinate speakers 22 and 32, it is possible to produce the pseudo-spherical waves 27 and 37.

In the above-described third and fourth preferred embodiments, although a pair of subordinate speakers 32 and 42 are arranged above and below the main speakers 31 and 41, the arrangement is not limited thereto, and it is also possible to arrange the subordinate speakers 32 and 42 in a multistage arrangement.

Furthermore, in the third preferred embodiment, a pseudo-spherical wave is generated by making the amplitude of an audio signal different between the main speaker 31 and the subordinate speakers 32, and in the fourth preferred embodiment, a pseudo-spherical wave is generated by making the spaces L1 and L2 different between the speakers 41 and 42 and the speaker boxes 43 or the floor surface 45. However, even if the amplitude of audio signals applied to the speakers 31 and 32 or 41 and 42 is substantially the same and the space L0 between the speakers 31 and 32 or 41 and 42 are substantially the same, the propagation speed of a sound wave is adjusted by changing the diameter of the speakers 31 and 32 or 41 and 42 or by providing a duct, port, slit, or other suitable structure in the sound wave propagation opening portions 38 and 39 or 48 and 49 to change the opening area. Thus, it is possible to generate the pseudo-spherical waves 37 and 47.

The present invention is not limited to each of the above-described preferred embodiments, and various modifications are possible within the range described in the claims. An embodiment obtained by appropriately combining technical features disclosed in each of the different preferred embodiments is included in the technical scope of the present invention.

What is claimed is:

1. A speaker system comprising:

a main speaker; and a subordinate speaker; wherein a pseudo-spherical wave having the main speaker at a center thereof is generated such that both speakers are vibrated in a frequency range of piston vibration and are in phase with each other and a propagation speed of a sound wave produced by vibration of the subordinate speaker is less than a propagation speed of a sound wave produced by vibration of the main speaker;

the main speaker and the subordinate speaker are arranged substantially on the same surface so as to face in the same direction and so as not to lie one on top of another and such that the subordinate speaker is vibrated with a smaller amplitude than the main speaker; and a diameter of the subordinate speaker is greater than a diameter of the main speaker, and the subordinate and main speakers have the same axis.

2. A speaker system as claimed in claim 1, wherein a plurality of the subordinate speakers are provided and the farther the subordinate speaker is located from the main speaker, the smaller amplitude with which the subordinate speaker is vibrated.

3. A speaker system comprising:

a main speaker; and at least one subordinate speaker; wherein the main speaker and the at least one subordinate speaker are arranged such that a pseudo-spherical wave having the main speaker at a center thereof is generated and the main speaker and at least one subordinate speaker are vibrated in a frequency range of piston vibration and are in phase with each other and a propagation speed of a sound wave produced by vibration of the subordinate speaker is less than a propagation speed of a sound wave produced by vibration of the main speaker;

the main speaker and the at least one subordinate speaker are arranged substantially on the same surface of a substrate so as to face in the same direction and so as not to lie one on top of another and such that the at least one subordinate speaker is vibrated with a smaller amplitude than the main speaker; and a diameter of the at least one subordinate speaker is greater than a diameter of the main speaker, and the at least one subordinate speaker and main speaker have the same axis.

4. A speaker system as claimed in claim 3, wherein the at least one subordinate speaker includes a plurality of the subordinate speakers, and the farther the subordinate speaker is located from the main speaker, the smaller amplitude with which the subordinate speaker is vibrated.

* * * * *